US007877907B1

(12) United States Patent
Hudick

(10) Patent No.: US 7,877,907 B1
(45) Date of Patent: Feb. 1, 2011

(54) BADGE OR DECORATION MOUNTING

(76) Inventor: Harry B. Hudick, 975 Cynthia Ave., Pasadena, CA (US) 91107

( * ) Notice: Subject to any disclaimer, the term of this patent is extended or adjusted under 35 U.S.C. 154(b) by 38 days.

(21) Appl. No.: 12/386,591

(22) Filed: Apr. 20, 2009

(51) Int. Cl.
*A44C 3/00* (2006.01)

(52) U.S. Cl. ..... 40/1.5; 40/661.04; 24/DIG. 41

(58) Field of Classification Search ..... 40/1.5, 40/1.6, 606.19, 661.04, 661.11; 24/662, 24/700, DIG. 41, 3.11, 3.12
See application file for complete search history.

(56) References Cited

U.S. PATENT DOCUMENTS

| | | | | | |
|---|---|---|---|---|---|
| 106,942 | A * | 8/1870 | Kirkpatrick | 40/1.5 |
| 175,334 | A * | 3/1876 | Carson | 24/21 |
| 2,834,129 | A * | 5/1958 | Kirkbride | 40/1.5 |
| 3,066,501 | A * | 12/1962 | Charles et al. | 63/39 |
| 4,137,657 | A * | 2/1979 | Wardle | 40/1.5 |
| 5,655,271 | A * | 8/1997 | Maxwell-Trumble et al. | 24/459 |
| 5,782,022 | A * | 7/1998 | Tubberville | 40/1.6 |
| 5,791,076 | A * | 8/1998 | Gailliard | 40/1.5 |
| 6,122,805 | A | 9/2000 | Haegley | |
| 6,446,372 | B1 * | 9/2002 | Reeves | 40/621 |
| 7,325,339 | B2 | 2/2008 | Jordan | |

* cited by examiner

*Primary Examiner*—Joanne Sibermann
*Assistant Examiner*—Kristina Staley
(74) *Attorney, Agent, or Firm*—William W. Haefliger

(57) ABSTRACT

A thin backing first support plate, for use with one or more retention pins that attach a display decoration to a shirt or jacket fabric, comprising the plate having one or more through openings to pass the pin or pins that are also passed through the uniform fabric, the plate having an edge notch or notches engageable by fabric under a user's finger or fingers, whereby the user can from the front side of the fabric sidewardly orient the plate relative to the decoration located at the front side of the fabric.

14 Claims, 5 Drawing Sheets

10
10a 2
2
15d
15f
10a
3
3
15b
20c
22
32a
17
W
L
20
20b
16
15a
l
W2
15c
15e
10

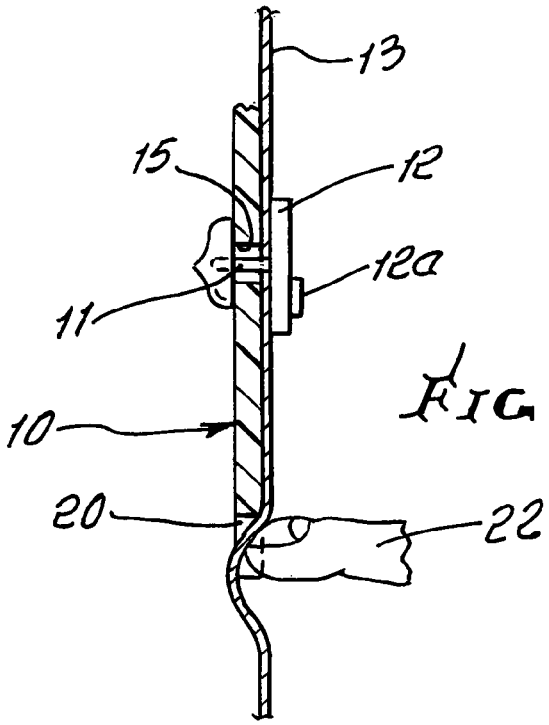
FIG. 3
FIG. 4
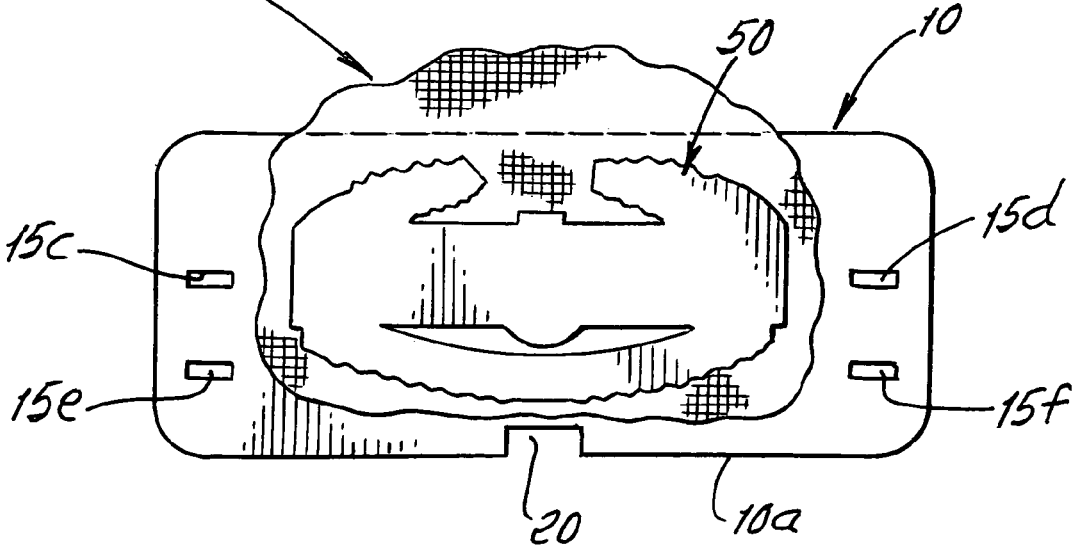

BADGE OR DECORATION MOUNTING

BACKGROUND OF THE INVENTION

The invention pertains generally to badge retention devices, as for example are used to pin badges on military uniforms, properly centered and properly spaced on the uniform itself as well as with respect to other badges on the uniform.

The problems solved include drastically decreasing the amount of time spent re-pinning military skill badges on uniforms as when changing to a clean uniform. The user needs to avoid use of a ruler or other measuring device to then measure, reposition, and re-measure repeatedly, to properly position the badges, the correct distances being built into the device of the invention. The invention also enables use to quickly pin military badges, such as US Army skill badges, on Army Combat Uniforms (ACU) at the proper spacing and distances both from the US Army nametape and between each badge, per Army Regulation AR 670-1 and Department of the Army written messages.

SUMMARY OF THE INVENTION

Basically the device of the invention comprises a support plate for use in combination with one or more retention pins that attach display badges or decorations to a shirt or jacket fabric, and characterized in that:

a) the plate has one or more through openings to pass a badge pin or pins that are also passed through the uniform fabric, b) that plate having an edge notch or notches engageable by fabric under a user's finger or fingers, whereby the user can from the front side of the fabric sidewardly orient the plate relative to the decoration located at the front side of the fabric.

As will be seen the plate has a lower horizontal edge at which the notch is located, preferably centrally, relative to a vertical, at opposite sides of which the badge pin openings are located. The notch provides spaced edges for engagement with a user's finger to stabilize the plate against twisting, as during orientation adjustment.

The centering notch is a critical feature in that it is used to quickly position the plastic plate relative to the uniform itself. The device also serves as a backer plate for the uniform and badge or badges, once pinned in place. The device can have slightly different forms for adaptation to different military uniforms including Navy, Marine Corps, Air Force and Coast Guard.

The device meets the need in the art of military uniforms and insignia for a device that can be used to quickly, accurately and flexibly pin skill badges on combat uniforms in a reliable, precise manner in a plurality of badge combinations.

In use the method includes the step a) exerting finger pressure through the fabric to engage edges defined by the notch, and b) sliding the plate against the fabric rear side, via said finger pressure exerted at the front side of the fabric, to position the plate prior to badge pin penetration through the fabric and through said opening or openings.

This invention solves at least two problems in particular:

1. The amount of time it takes to re-pin skill badges after removing them to either wash or simply change uniforms will be drastically reduced.

2. Badges pinned without the device are much more difficult to center and properly space; the present invention affords the individual the ability to pin badges quickly at the correct spacing, without having to use a measuring device.

Once pinned in place, the plate serves as a backer for uniform fabric around the badge, and which provides a neat, organized appearance when displaying the badges in place while wearing the uniform.

DRAWING DESCRIPTION

FIG. 3 is an enlarged section taken on lines 3-3 of FIG. 1;

FIG. 4 shows a badge mounted by the device of the invention, note fabric therebetween;

DETAILED DESCRIPTION

Figures 1, 2:
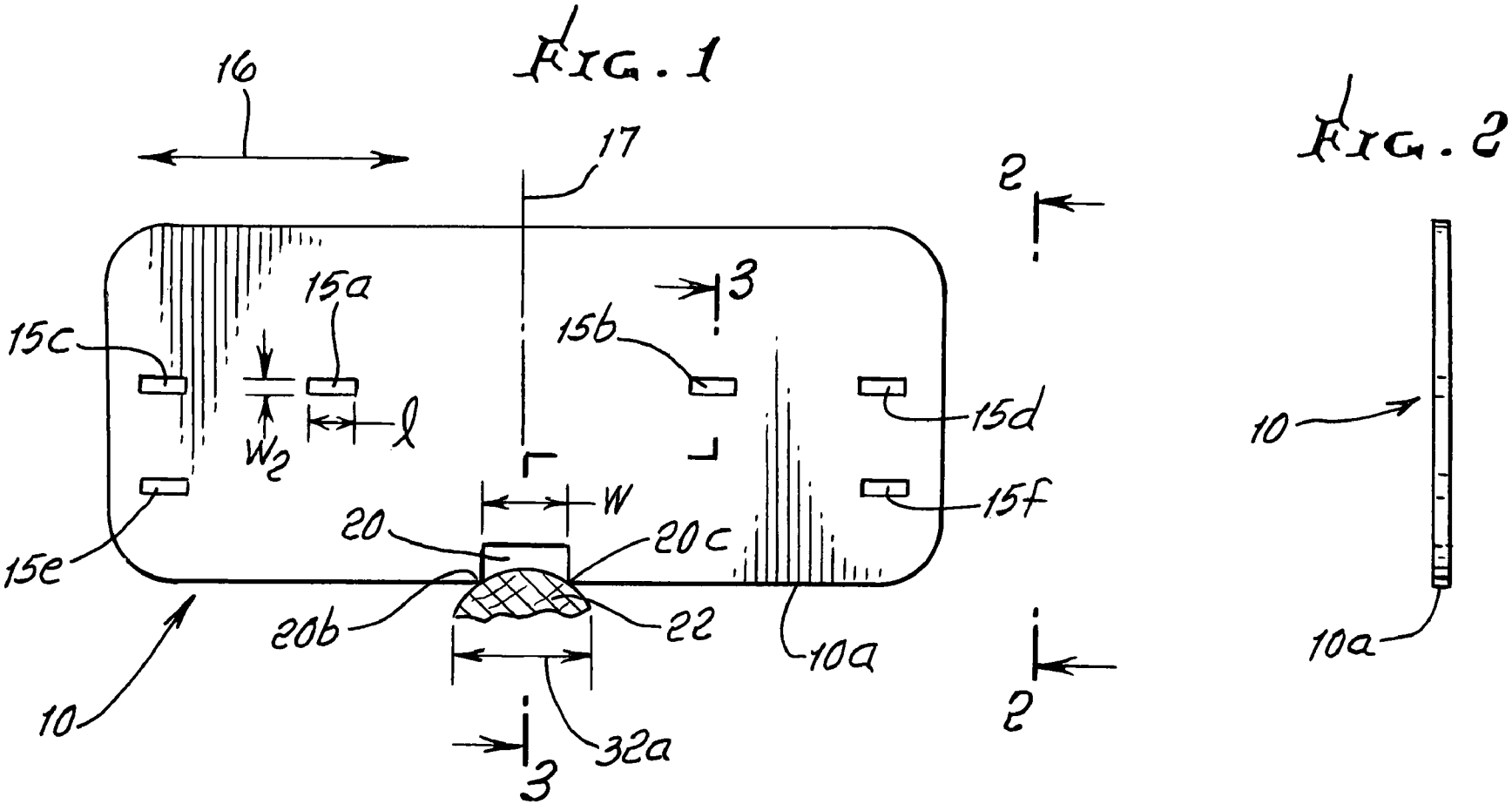
FIG. 1 is a front elevation showing a preferred support plate.
FIG. 2 is an edge view taken on lines 2-2 of FIG. 1.

In FIGS. 1-3, a thin backing first support 10 is provided, for use with one or more retention pins 11 as extend from the body 12 of a badge or decoration 12*a*. Such pins are adapted to be extended through, i.e. from the front side to the rear side, of the wearer's shirt or jacket fabric layer or sheet indicated at 13. A clasp 14 fits over the end of the pin, at the rear side of the support 10, which may comprise a thin plate or panel, which acts as a firm flat backer against the garment sheet 13, against which the garment sheet is held.

The support 10, typically consisting of molded plastic, has one or more through openings 15 to pass the pin or pins; and such openings are shown as elongated in the length direction of the support, i.e. the direction of arrow 16, and their elongation allows for lengthwise adjustment of the support, during its position adjustment application to the garment, with badge pins projecting through the openings. Also, the openings are located in a row or rows as shown, but typically offset in direction 16, to the left and right of the center line 17 of the support, for balanced, adjusted attachment of the backing support to the garment, as well as balanced support of the body 12 of the decoration or badge. Openings 15*a* and 15*b* are equally spaced from line 17; openings 15*c* and 15*d* are equally spaced from line 17; and openings 15*e* and 15*f* are equally spaced from line 17.

It is a feature of the invention that the support plate 10 has discontinuity, such as a notch 20 positioned along the plate lower edge 10*a*, to be blindly engaged by the user's finger 22, or fingers, via fabric as the plate is adjustably positioned adjacent the rear side of the fabric layer 13, whereby the user or badge wearer can accurately sidewardly orient the plate relative to the pin or pins of the badge location, at the front side of the shirt or jacket fabric layer. This result is enhanced by the fact that the notch width relative to the pin or pins of the badge location, at the front side of the shirt or jacket fabric layer. This result is enhanced by the fact that the notch width "w" is substantially less than the finger width 32*a*, whereby the finger convex surface engages, via deflected fabric, the two sharp edges 20*b* and 20*c* of the notch, tending to stabilize the plate 20 against twisting as it is shifted up or down, or sidewise, during position adjustment, in surface to surface engagement with the fabric 13.

Also, the notch is positioned to medially intersect center line 17 of the support, whereby tendency of the support to twist (due to rubbing against 13) during elevation of the finger 22 in engagement with points 20*b* and 20*c* is minimized. The notch width "w" is typically about 8 millimeters, for best adjustment results, the lengths "1" of the elongated openings are about 4 millimeters, and their widths $w_2$ are about 2 millimeters. The notch is, for best adjustment results, located below the levels of the openings.

Figure 5:
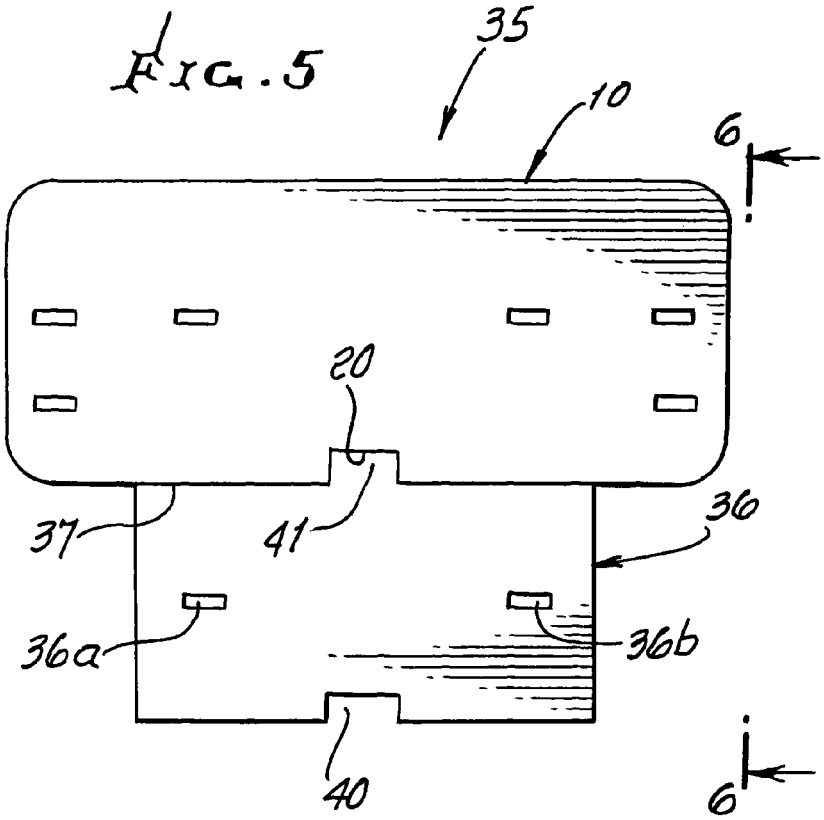
FIG. 5 shows a modified support plate.
Figure 6:
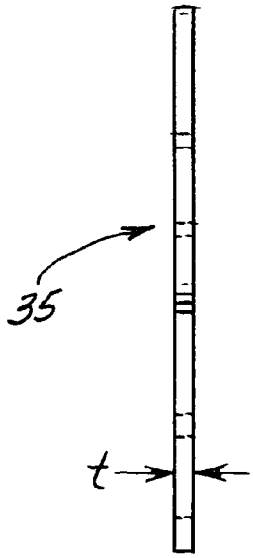
FIG. 6 is an edge view taken on lines 6-6 of FIG. 5.
Figure 7:
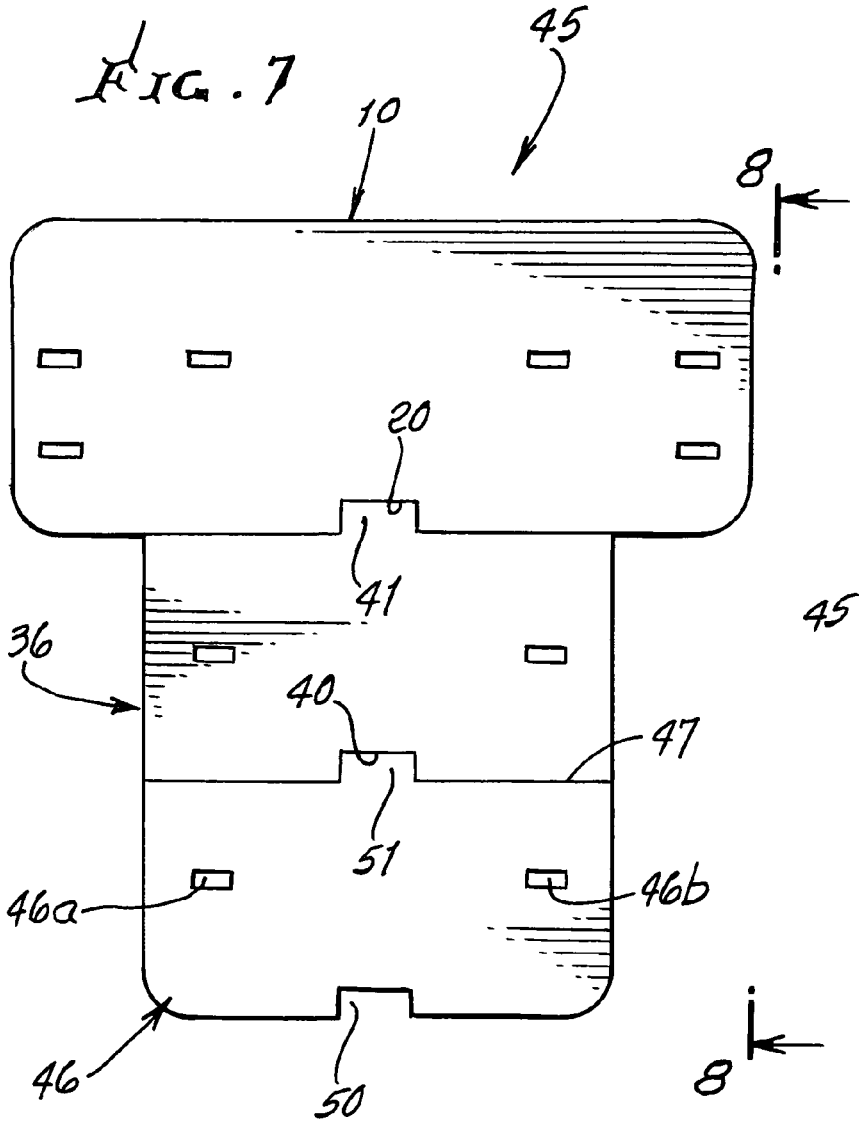
FIG. 7 shows a further modified support plate.
Figure 8:
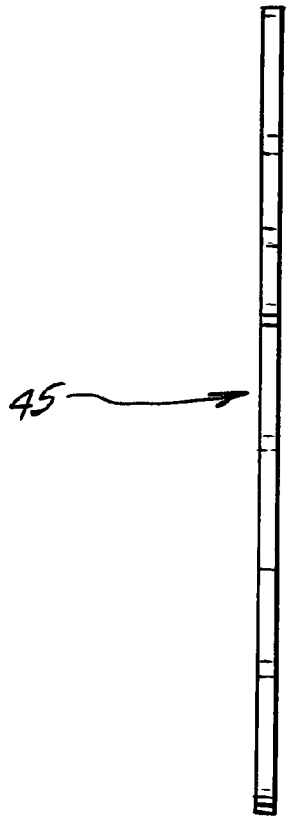
FIG. 8 is an edge view taken on lines 8-8 of FIG. 1.

FIG. 5 shows a modified overall support plate 35 having additional plate 36 attached to plate 10 along the upper edge of 36 and along the lower edge of 10. If needed, the connection or attachment locus 37 can be severed to allow plate 10 to function as described above, at FIGS. 1 and 3. Plate 36 has two laterally elongated openings 36*a* and 36*b*, directly below two of the openings in plate 10, as well as a notch 40, like notch 20, as described. Notch 40 is centrally located at the lower edge of plate 36. Notches 20 and 40 are alike and in direct vertical alignment, and an upper flange 41 on plate 36 fits in notch 20, since notch 40 now serves as an adjustment means for the overall plate 35. FIG. 6 is a view taken on lines 6-6 of FIG. 5. The thickness "t" of the plate 35 is about 2 millimeters, and the plastic is preferably translucent to enable viewing of the user's fingers, through the plate, to aid adjustment. Openings 36*a* and 36*b* are adapted to receive badge pins as referred to, and to accommodate their FIG. 7 shows a further modified overall support plate 45 having an additional plate 46 attached to plate 36, along the upper edge of 46 and along the lower edge of 36. If needed, the connection or attachment locus 47 can be severed to allow plates 10 and 36 to function as overall plate 35, referred to in FIGS. 5 and 6. Plate 46 has two laterally elongated openings 46*a* and 46*b*, like openings 15*a*-15*f*, and 36*a* and 36*b*, directly below two of the openings in plate 10, and below openings 36*a* and 36*b*, as shown. A notch 50 is provided for finger engagement, as described for notch 20. Notches 20, 40 and 50 are alike and in direct vertical alignment. An upper flange 51 on plate 46 fits in notch 40, since notch 50 now serves as an adjustment means for the overall plate 45. FIG. 8 is a view taken on lines 8-8 of FIG. 7. Openings 46*a* and 46*b* are adapted to receive badge pins.

In normal use, the device functions as follows: the user utilizes the centering notch (20, 40, or 50) to center the plate on the back side of the uniform fabric. The user then uses a fingertip to locate the notch, via pressure exerted through the uniform front side fabric, places the uniform on a flat surface with the backer plate centered at the inside of the uniform, and held in place. He then finds the first hole 15 by feeling through the front side of the fabric to find the hole in the plastic and then simply pins the badge by pushing the pins through the fabric and holes. He then attaches the clasps, and then pins the next badge in place, in succession, until complete. The user can then trim the plate for other badge combinations by cutting along the pre-molded outline at 37 or 47 with scissors or other cutting device.

The invention provides skill badge support templates made of plastic for use as for example specifically with combat camouflage military uniforms of the US Army, Navy, Air Force and Marines for pinning subdued, black skill badges using the built in rearward projected prongs or pins at a pre-configured spacing, both vertically from one badge to the next, and vertically from a predetermined area of the uniform, for example the US Army tape at the distances and spacing specified in military regulations. The device centering notch at the bottom center is used to center the device prior to pinning skill badges. The device typically consists of a flat "T" spaced surface to be positioned on the inside of the uniform jacket pre-configured with pre-positioned generally oval shaped openings set to receive the prongs of the skill badges pinned on the front side of the jacket pinned through the fabric of the uniform and secured on the backside of the uniform, as by clasp fasteners that accompany the badges.

Notch gap width is preferably less than finger width so that the finger can bridge the two notch edges 20*b* and 20*c*, and is preferably greater than 3 millimeters, so that plate stabilizing pressure can be transmitted via the finger to the plate.

Figure 9:
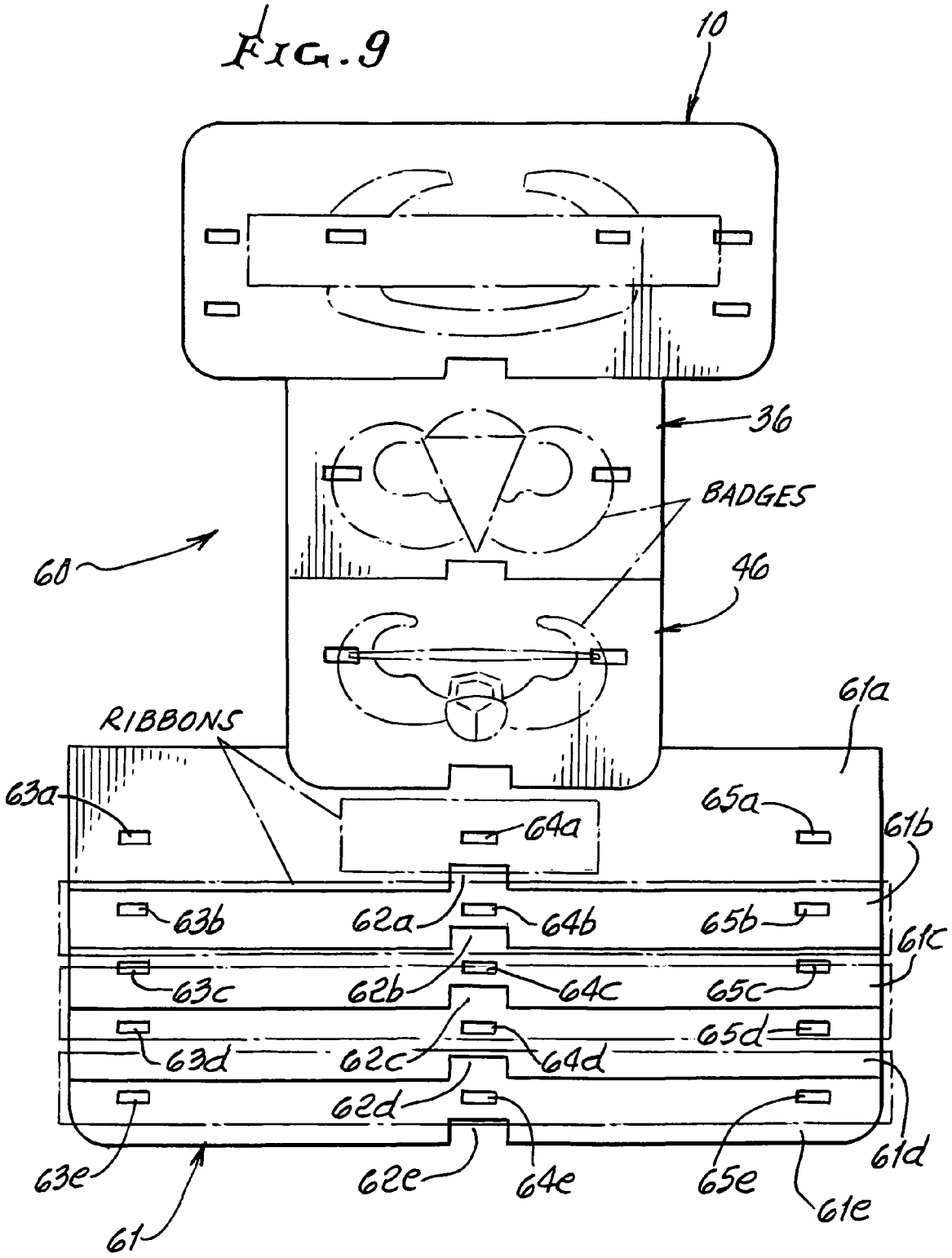
FIG. 9 shows a further modified support plate, for badges and ribbons.

FIG. 9 shows a further modified support plate 60 incorporating plates 10, 36 and 46, and also, a wider lower plate 61 with sub sections 61*a*-61*e* having aligned notches 62*a*-62*e*, and ribbon display pin openings 63*a*-6*e*, 64*a*-64*e* and 65*a*-65*e*.

I claim:

1. A combination comprising a thin backing first support plate, for use with one or more retention pins that attach a display decoration to a shirt or jacket fabric, comprising:

a) the plate having one or more through openings to pass the pin or pins that are also passed through the fabric, b) said plate having an edge and an edge notch or notches interrupting said plate edge and engageable by fabric under a user's finger or fingers, whereby the user can from the front side of the fabric sidewardly orient the plate relative to the decoration located at the front side of the fabric, c) said edge notch or notches confined to a plane defined by the main extent of the plate, d) said notch or notches having spaced corners at the plate edge, the notch or notches extending away from the corners into the plate.

2. The combination of claim 1 wherein the plate is upright and generally rectangular, the plate having a generally horizontal edge at which said notch is located.

3. The combination of claim 2 wherein the notch is located at the plate lower horizontal edge, and generally vertically between plate laterally spaced upright edges.

4. The combination of claim 1 including a second plate associated with the first defined plate and also having one or more through openings to pass retention pins, said second plate extending generally upright, and the second plate located adjacently below the first plate, the second plate also having an edge notch to be finger pressure pressed for second plate adjusted positioning, from the front side of the fabric.

5. The combination of claim 4 including a third plate associated with the second plate also having one or more through openings to pass retention pins, said third plate extending generally upright, and the second plate located adjacently below the first plate, the second plate also having an edge notch to be finger pressure pressed for second plate adjusted positioning, from the front side of the fabric.

6. The combination of claim 5 wherein the third plate extends edge adjacently below the second plate.

7. The combination of claim 4 wherein the notches of the first and second plates are in substantial vertical alignment.

8. The combination of claim 6 wherein the notches in all three plates are in substantial vertical alignment.

9. The combination of claim 1 including said pins extending through plate openings which are laterally elongated, and fasteners attached to the pins, adjacent the plate.

10. The combination of claim 4 including said pins extending through said plate openings in both plates, and fasteners attached to the pins.

11. The combination of claim 1 wherein the notch has width less than finger width, and greater than 2 millimeters.

12. The combination of claim 5 including said pins extending through the openings in all three plates, and fasteners attached to the pins, and including said decorations located at the front sides of the plates.

13. The combination of claim 1 wherein the fabric is deflected by finger pressure exerted at the front side of the plate and transmitted to notch edges via the fabric.

14. The method of use of the support plate as defined in claim 1, which includes steps:

a) exerting finger pressure through the fabric to engage an edge or edges defined by the notch, and b) sliding the plate against a fabric rear side, via said finger pressure exerted at a front side of the fabric, to position the plate prior to badge pin penetration through the fabric and through said opening or openings

.

* * * * *